US010772363B1

(12) United States Patent
Berenguer

(10) Patent No.: US 10,772,363 B1
(45) Date of Patent: Sep. 15, 2020

(54) STORAGE SASH APPARATUS

(71) Applicant: Lynda Mary Berenguer, Santa Ana, CA (US)

(72) Inventor: Lynda Mary Berenguer, Santa Ana, CA (US)

( * ) Notice: Subject to any disclaimer, the term of this patent is extended or adjusted under 35 U.S.C. 154(b) by 0 days.

(21) Appl. No.: 16/779,935

(22) Filed: Feb. 3, 2020

(51) Int. Cl.

| | |
|---|---|
| ***A41D 13/00*** | (2006.01) |
| ***A45F 5/00*** | (2006.01) |
| ***A45C 13/02*** | (2006.01) |
| ***A41D 23/00*** | (2006.01) |
| ***A45C 11/18*** | (2006.01) |
| *A45C 11/00* | (2006.01) |

(52) U.S. Cl.
CPC ..... *A41D 13/0012* (2013.01); *A41D 23/00* (2013.01); *A45C 11/182* (2013.01); *A45C 13/023* (2013.01); *A45F 5/00* (2013.01); *A45C 2011/007* (2013.01)

(58) Field of Classification Search
CPC ... A41D 2023/004; A41D 20/00; A41D 27/20
See application file for complete search history.

(56) References Cited

U.S. PATENT DOCUMENTS 2,870,448 A * 1/1959 Rosenthal ..... A41D 1/04 2/91
4,109,321 A * 8/1978 Shapiro ..... A41D 23/00 2/91
4,641,655 A * 2/1987 Abt ..... A61F 7/10 383/901
5,025,508 A * 6/1991 Duncan ..... A41D 23/00 2/207
5,072,598 A * 12/1991 Dibrell ..... A41D 13/0055 2/91
5,088,549 A * 2/1992 Schneider ..... A61F 7/02 165/46
5,265,669 A * 11/1993 Schneider ..... A61F 7/02 165/46
9,149,078 B1 * 10/2015 Curtin ..... A41D 23/00
2005/0039242 A1 * 2/2005 Edmondson ..... A42B 1/241 2/207
2005/0125878 A1 * 6/2005 Bjelland ..... A41D 23/00 2/207
2006/0129212 A1 * 6/2006 Halvorson ..... A61F 7/02 607/96

(Continued)

*Primary Examiner* — Brian D Nash
(74) *Attorney, Agent, or Firm* — Entralta P.C.; Justin G. Sanders; Peter D. Weinstein

(57) ABSTRACT

A storage sash apparatus is disclosed and configured for securely and covertly storing personal items therewithin. In at least one embodiment, the apparatus provides an elongate sash sized and configured for being wrapped around and removably engaged with at least one of a wrist, forearm, arm, neck, leg and ankle of a user. The sash provides opposing ends configured for removable engagement with one another. The sash also defines an at least one compartment between opposing first and second panels of the sash, with the at least one compartment being sized and positioned for removably receiving at least one personal item therewithin. During use of the apparatus, the sash is wrapped at least once around the user, and the opposing ends are then removably engaged with one another, thereby securing the apparatus to the user while allowing access to the at least one compartment.

19 Claims, 3 Drawing Sheets

(56) References Cited

U.S. PATENT DOCUMENTS

| | | | | |
|---|---|---|---|---|
| 2008/0184996 | A1* | 8/2008 | Colorado | A41D 13/1161<br>128/201.25 |
| 2013/0061370 | A1* | 3/2013 | Ezell | A41D 23/00<br>2/207 |
| 2015/0201687 | A1* | 7/2015 | Graves | A41D 23/00<br>2/207 |
| 2015/0230527 | A1* | 8/2015 | Branson | A41D 23/00<br>2/181 |
| 2017/0208881 | A1* | 7/2017 | Leathers | A41D 23/00 |
| 2020/0085126 | A1* | 3/2020 | Barnes | A41D 27/08 |

* cited by examiner

STORAGE SASH APPARATUS

RELATED APPLICATIONS

Not applicable.

BACKGROUND

The subject of this patent application relates generally to fashion accessories, and more particularly to a storage sash apparatus configured for securely and covertly storing personal items therewithin.

Applicant hereby incorporates herein by reference any and all patents and published patent applications cited or referred to in this application.

By way of background, while purses and other types of bags are commonly used to carry around one's everyday personal items, there are occasions where having to carry around such a bag is less than ideal. For example, now that bag checks are becoming more and more common at places such as amusement parks, theaters, and concert venues, people are beginning to opt for leaving their bags at home in order to avoid bag check lines. Bags can also be cumbersome to carry around, which could visually detract from one's wardrobe in certain situations, and which could also create an opportunity for theft in other situations. However, certain personal items (such as identification cards, money, credit/debit cards, keys, medications, vitamins, etc.) must nevertheless be carried on one's person at all times. Thus, there is a need for a wearable, relatively compact apparatus that is capable of storing such important personal items in lieu of a traditional bag.

Aspects of the present invention fulfill these needs and provide further related advantages as described in the following summary.

It should be noted that the above background description includes information that may be useful in understanding aspects of the present invention. It is not an admission that any of the information provided herein is prior art or relevant to the presently claimed invention, or that any publication specifically or implicitly referenced is prior art.

SUMMARY

Aspects of the present invention teach certain benefits in construction and use which give rise to the exemplary advantages described below.

The present invention solves the problems described above by providing a storage sash apparatus configured for securely and covertly storing personal items therewithin. In at least one embodiment, the apparatus provides an elongate sash sized and configured for being wrapped around and removably engaged with at least one of a wrist, forearm, arm, neck, leg and ankle of a user, the sash comprising a first panel and an opposing second panel joined to the first panel. The sash provides opposing ends configured for removable engagement with one another. The sash also defines an at least one compartment between the first and second panels, with the at least one compartment being sized and positioned for removably receiving at least one personal item therewithin. The first and second panels define an at least one opening for allowing access into the at least one compartment. During use of the apparatus, the sash is wrapped at least once around the user, and the opposing ends are then removably engaged with one another, thereby securing the apparatus to the user while allowing access to the at least one compartment.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION

Figure 1:
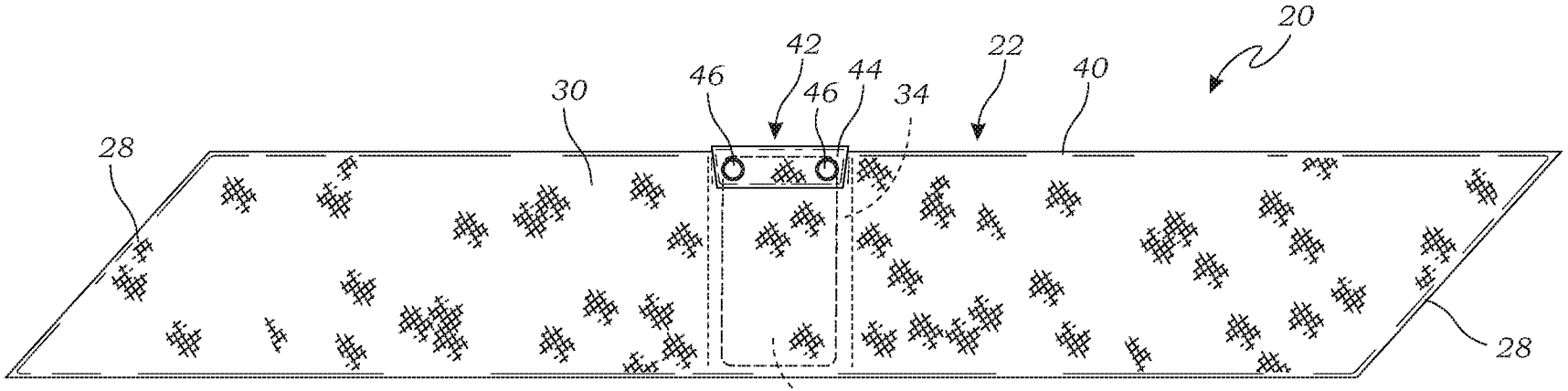
FIG. 1 is a front elevational view of an exemplary storage sash apparatus, in accordance with at least one embodiment.
Figure 2:
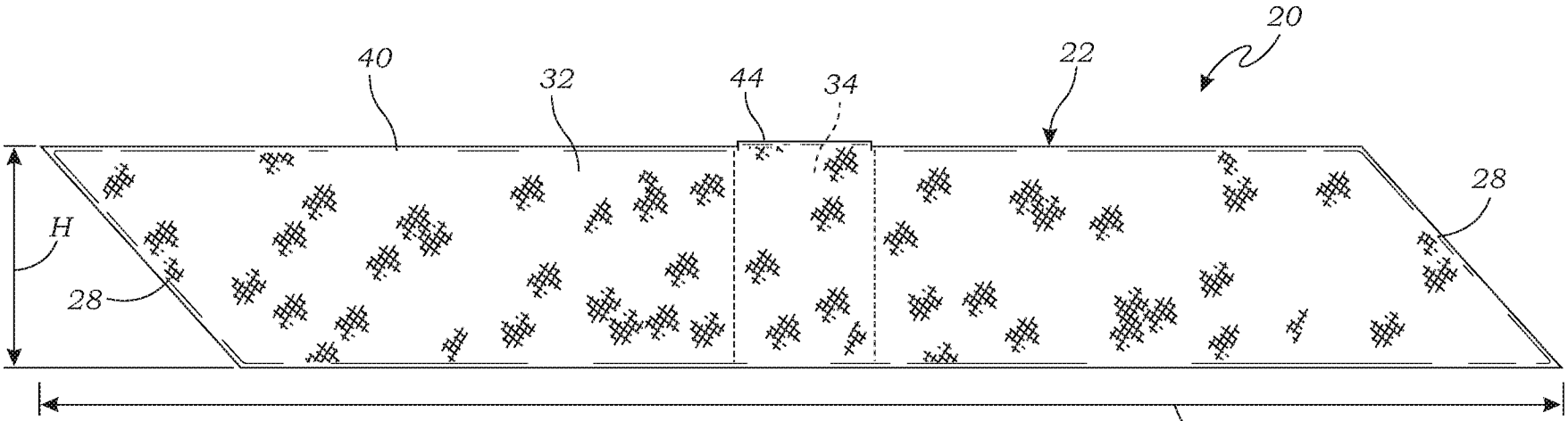
FIG. 2 is a rear elevational view thereof, in accordance with at least one embodiment.
Figure 3:
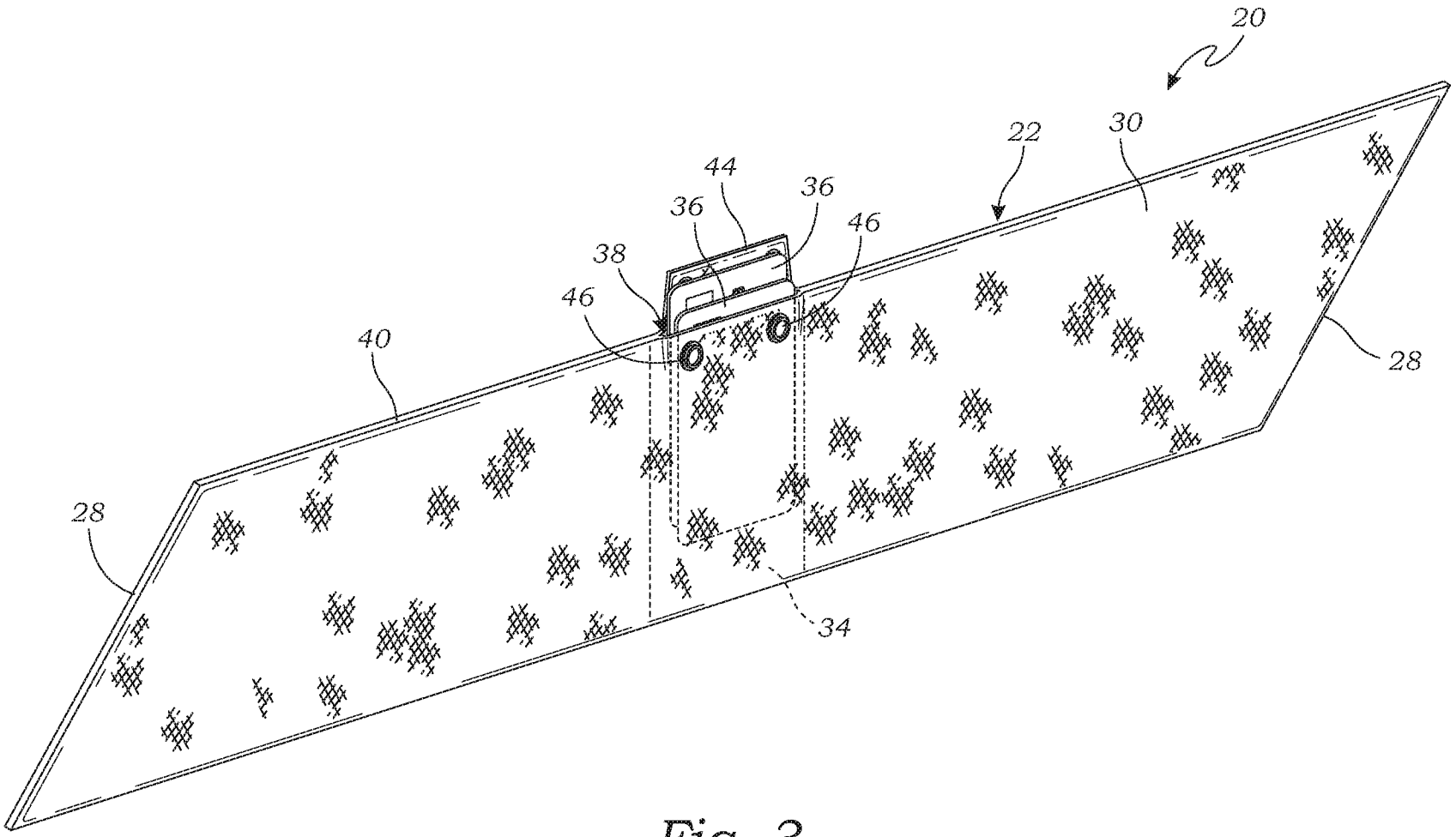
FIG. 3 is a perspective view thereof, in accordance with at least one embodiment.

Turning now to FIGS. 1-3, there is shown an exemplary embodiment of a storage sash apparatus 20. In at least one embodiment, the apparatus 20 comprises an elongate sash 22 sized and configured for being wrapped around and removably engaged with a wrist 24 of a user 26 (FIG. 4), with opposing ends 28 of the sash 22 configured for removable engagement with one another, as discussed further below. In at least one such embodiment, as illustrated in FIG. 2, the sash 22 has a length L of approximately twenty-eight inches and a height H of approximately four inches. In further embodiments, the sash 22 is sized and configured for being wrapped around and removably engaged with other parts of the user 26, such as a forearm, arm, neck, leg or ankle of the user 26, for example. In that regard, it should be noted that the size, shape and dimensions of the sash 22 as depicted in the drawings (and as described herein) is merely exemplary; thus, in further embodiments, the sash 22 may take on any other size, shape and/or dimensions, now known or later developed, so long as the apparatus 20 is capable of substantially carrying out the functionality described herein. In at least one embodiment, the sash 22 is constructed out of a relatively flexible material, such as fabric, mesh, plastic, leather or rubber for example. In further embodiments, the sash 22 may be constructed out of any other material (or combination of materials)—now known or later developed—capable of allowing the sash 22 to substantially carry out the functionality described herein.

With continued reference to FIGS. 1-3, in at least one embodiment, the sash 22 comprises a first panel 30 and an opposing second panel 32 joined to the first panel 30. In the exemplary embodiment, the first and second panels 30 and 32 are joined using stitching; however, in further embodiments, any other techniques or mechanisms for joining the first and second panels 30 and 32, now known or later developed—such as welding, adhesives, etc. —may be substituted. In at least one embodiment, the sash 22 defines an at least one compartment 34 between the first and second panels 30 and 32 sized and positioned for removably receiving an at least one personal item 36 (such as identification cards, money, credit/debit cards, keys, medications, vitamins, etc.) therewithin. In at least one embodiment, an inner surface of the at least one compartment 34 provides a relatively high friction material for assisting in preventing the at least one personal item 36 from unintentionally falling out of the compartment 34. Additionally, in at least one further embodiment (not shown), the at least one compartment 34 provides an at least one sub-compartment positioned therewithin, thereby allowing the user 26 to separate and organize the contents of the at least one compartment 34.

In at least one embodiment, as best illustrated in FIG. 3, the first and second panels 30 and 32 define an at least one opening 38 for allowing access into the at least one compartment 34. In at least one such embodiment, the at least one opening 38 is positioned along a top edge 40 of the sash 22, proximal a middle of the sash 22. However, in further embodiments, the at least one opening 38 may be positioned anywhere else on the sash 22—whether along an edge of the sash 22 or elsewhere on the first or second panels 30 and 32. In at least one such embodiment, the at least one opening 38 provides a closure 42 for selectively obstructing the opening 38 and preventing the at least one personal item 36 from unintentionally falling out of the compartment 34. In at least one embodiment, the closure 42 is a flap 44 that is removably engagable using snaps 46, buttons, buckles, hook-and-loop material, magnets, zippers or any other non-permanent engagement mechanism (or combination of mechanisms) now known or later developed.

In at least one such embodiment, the flap 44 is secured to (or is otherwise integral with) the second panel 32 and configured for being folded over the opening 38 and engaging the first panel 30. In at least one further embodiment, the flap 44 is omitted and the first and second panels 30 and 32 provide complementary non-permanent engagement mechanisms capable of selectively closing the opening 38 when the engagement mechanisms are engaged with one another. In still further embodiments, any other structure or mechanism (now known or later developed) capable of selectively obstructing the opening 38 may be substituted. In at least one still further embodiment, rather than provide at least one opening 38, the first and second panels 30 and 32 are instead removably engagable with one another (either completely or partially), thereby allowing access into the at least one compartment 34 when the first and second panels 30 and 32 are separated. In such embodiments, the first and second panels 30 and 32 are at least partially removably engaged with one another using snaps, buttons, buckles, hook-and-loop material, magnets, zippers or any other non-permanent engagement mechanism (or combination of mechanisms) now known or later developed. It should be noted that the size, shape, dimensions, quantity and position of the at least one compartment 34 and corresponding opening 38 relative to the sash 22 as depicted in the drawings is merely exemplary. As such, in further embodiments, each of the at least one compartment 34 and corresponding opening 38 may take on any other size, shape, dimensions and/or quantity, now known or later developed, and may be positioned and/or arranged elsewhere on the sash 22, so long as the apparatus 20 is capable of substantially carrying out the functionality described herein.

Figure 4:
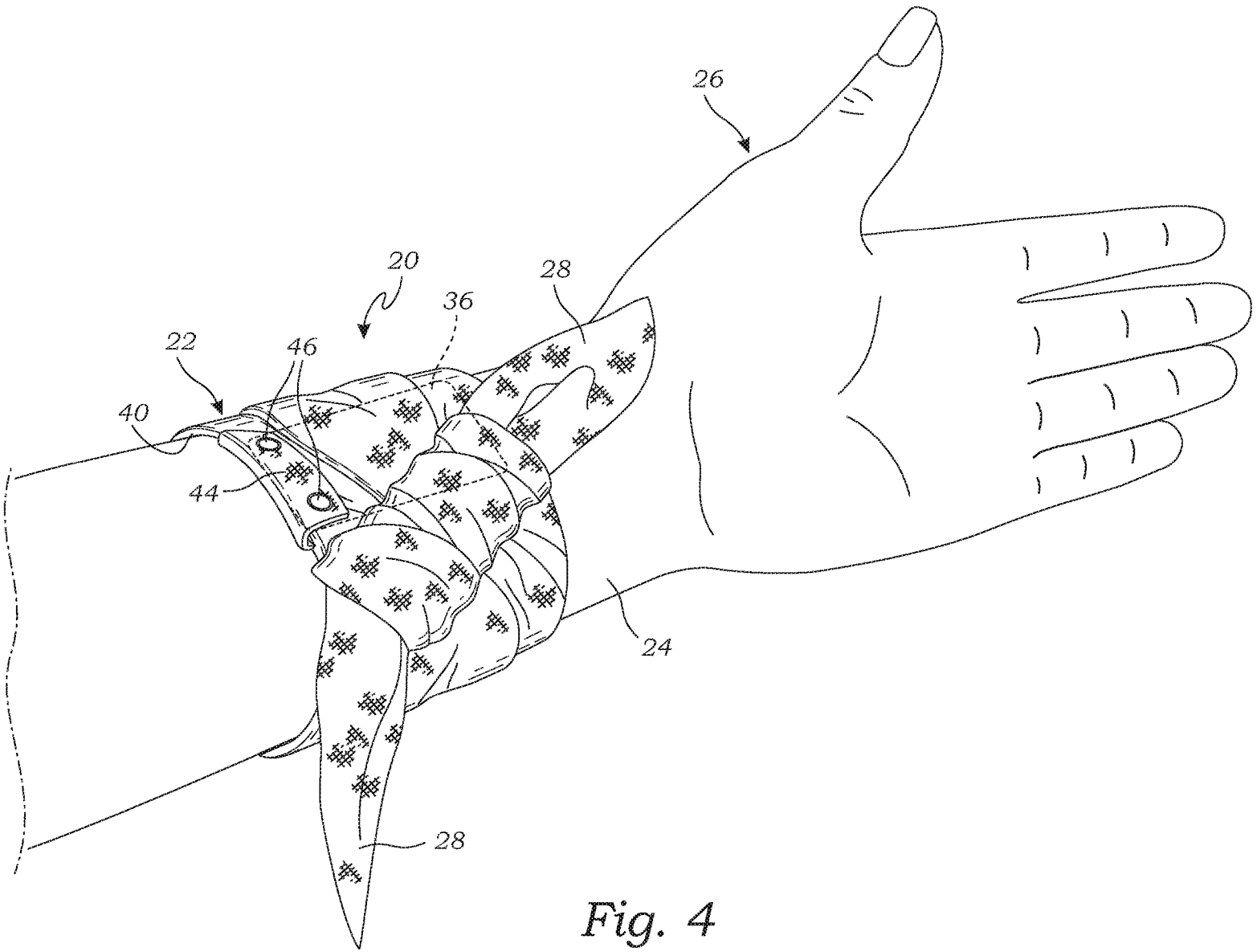
FIG. 4 is a further perspective view thereof as wrapped around and removably engaged with a wrist of a user, in accordance with at least one embodiment.

As mentioned above, the opposing ends 28 of the sash 22 are configured for removable engagement with one another after being wrapped at least once around the user's wrist 24, forearm, arm, neck, leg, ankle, etc. (hereinafter generally referred to as the user 26 for simplicity purposes), thereby maintaining the apparatus 20 in the desired position relative to user 26 during use. In at least one embodiment, as illustrated in FIG. 4, the ends 28 of the sash 22 are of a sufficient length so as to be tied together after being wrapped at least once around the user 26. In at least one further embodiment, the ends 28 of the sash 22 provide complementary non-permanent engagement mechanisms such as snaps, buttons, buckles, hook-and-loop material, magnets, zippers or any other non-permanent engagement mechanism (or combination of mechanisms) now known or later developed. In at least one embodiment, as again illustrated in FIG. 4, the ends 28 of the sash 22 are configured for being engaged in a position substantially overtop of the at least one compartment 34, thereby applying an amount of pressure against the at least one compartment 34 so as to assist in preventing the at least one personal item 36 from unintentionally falling out of the compartment 34. In at least one alternate embodiment, if the opposing ends 28 of the sash 22 aren't engaged in a position substantially overtop of the at least one compartment 34, the ends 28 at least pass overtop of the at least one compartment 34 as the sash 22 is wrapped at least once around the user 26. In at least one further embodiment (not shown), the ends of the sash 22 are integral or otherwise permanently secured with one another, such that the sash 22 forms a continuous loop. In such a further embodiment, the user 26 is capable of temporarily stretching and pulling the apparatus 20 onto the desired portion of their body, and subsequently wrapping the sash 22 at least once around the desired portion of their body.

Thus, with the at least one personal item 36 securely and covertly positioned within the at least one compartment 34, the apparatus 20 is capable of being comfortably worn by the user 26 without fear of losing the at least one personal item 36. Additionally, due to the relative positioning of the corresponding at least one opening 38 in at least one embodiment, the user 26 is able to selectively remove and insert the at least one personal item 36 without having to disengage the entire apparatus 20.

Aspects of the present specification may also be described as the following embodiments:

1. A storage sash apparatus comprising: an elongate sash sized and configured for being wrapped around and removably engaged with at least one of a wrist, forearm, arm, neck, leg and ankle of a user, the sash comprising a first panel and an opposing second panel joined to the first panel; the sash providing opposing ends configured for removable engagement with one another; the sash defining an at least one compartment between the first and second panels, the at least one compartment sized and positioned for removably receiving an at least one personal item therewithin; and the first and second panels defining an at least one opening for allowing access into the at least one compartment; whereby, during use of the apparatus, the sash is wrapped at least once around the user, and the opposing ends are then removably engaged with one another, thereby securing the apparatus to the user while allowing access to the at least one compartment.

2. The storage sash apparatus according to embodiment 1, wherein the sash has a length of approximately twenty-eight inches and a height of approximately four inches.

3. The storage sash apparatus according to embodiments 1-2, wherein the sash is constructed out of a flexible material.

4. The storage sash apparatus according to embodiments 1-3, wherein the flexible material is at least one of fabric, mesh, plastic, leather and rubber.

5. The storage sash apparatus according to embodiments 1-4, wherein an inner surface of the at least one compartment provides a high friction material for assisting in preventing the at least one personal item from unintentionally falling out of the compartment.

6. The storage sash apparatus according to embodiments 1-5, wherein the at least one opening is positioned along a top edge of the sash.

7. The storage sash apparatus according to embodiments 1-6, wherein the at least one opening is further positioned proximal a middle of the sash.

8. The storage sash apparatus according to embodiments 1-7, wherein the at least one opening provides a closure for selectively obstructing the opening and preventing the at least one personal item from unintentionally falling out of the compartment.

9. The storage sash apparatus according to embodiments 1-8, wherein the closure is a removably engagable flap.

10. The storage sash apparatus according to embodiments 1-9, wherein the flap is secured to, or otherwise integral with, the second panel and configured for being folded over the opening and engaging the first panel.

11. The storage sash apparatus according to embodiments 1-10, wherein the closure is an at least one pair of complementary non-permanent engagement mechanisms positioned on each of the first and second panels.

12. The storage sash apparatus according to embodiments 1-11, wherein the ends of the sash are configured for passing overtop of the at least one compartment when the sash is wrapped around the user.

13. The storage sash apparatus according to embodiments 1-12, wherein the ends of the sash are configured for being tied together after the sash is wrapped at least once around the user.

14. The storage sash apparatus according to embodiments 1-13, wherein the ends of the sash provide complementary non-permanent engagement mechanisms.

15. The storage sash apparatus according to embodiments 1-14, wherein the ends of the sash are configured for being engaged in a position substantially overtop of the at least one compartment.

16. A storage sash apparatus comprising: an elongate sash sized and configured for being wrapped around and removably engaged with a wrist of a user, the sash comprising a first panel and an opposing second panel joined to the first panel; the sash providing opposing ends configured for removable engagement with one another; the sash defining an at least one compartment between the first and second panels, the at least one compartment sized and positioned for removably receiving an at least one personal item therewithin; the first and second panels defining an at least one opening for allowing access into the at least one compartment, the at least one opening positioned along a top edge of the sash, proximal a middle of the sash; and the second panel providing a flap positioned and configured for selectively folding over the opening and engaging the first panel, thereby obstructing the opening and preventing the at least one personal item from unintentionally falling out of the compartment; whereby, during use of the apparatus, the sash is wrapped at least once around the user's wrist, and the opposing ends are then removably engaged with one another, thereby securing the apparatus to the user's wrist while allowing access to the at least one compartment.

17. A method of wearing the storage sash apparatus of claim 16 comprising the steps of: placing the second panel of the sash in contact with the wrist of the user, such that the at least one compartment is positioned on an inner surface of the user's wrist; wrapping the sash at least once around the user's wrist so that the opposing ends of the sash pass overtop of the at least one compartment; and tying the ends of the sash together so as to secure the sash in place on the user's wrist while allowing access to the at least one compartment via the removably engagable flap.

In closing, regarding the exemplary embodiments of the present invention as shown and described herein, it will be appreciated that a storage sash apparatus is disclosed and configured for securely and covertly storing personal items therewithin. Because the principles of the invention may be practiced in a number of configurations beyond those shown and described, it is to be understood that the invention is not in any way limited by the exemplary embodiments, but is generally directed to a storage sash apparatus and is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention.

Certain embodiments of the present invention are described herein, including the best mode known to the inventor(s) for carrying out the invention. Of course, variations on these described embodiments will become apparent to those of ordinary skill in the art upon reading the foregoing description. The inventor(s) expect skilled artisans to employ such variations as appropriate, and the inventor(s) intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

Groupings of alternative embodiments, elements, or steps of the present invention are not to be construed as limitations. Each group member may be referred to and claimed individually or in any combination with other group members disclosed herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. At the very least, and not as an attempt to limit the application of the doctrine of equivalents to the scope of the claims, each numerical indication should at least be construed in light of the number of reported significant digits and by applying ordinary rounding techniques. Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein. Similarly, as used herein, unless indicated to the contrary, the term "substantially" is a term of degree intended to indicate an approximation of the characteristic, item, quantity, parameter, property, or term so qualified, encompassing a range that can be understood and construed by those of ordinary skill in the art.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as "first," "second," "third," etc. —for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples, or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising" (along with equivalent open-ended transitional phrases thereof such as "including," "containing" and "having") encompasses all the expressly recited elements, limitations, steps and/or features alone or in combination with un-recited subject matter; the named elements, limitations and/or features are essential, but other unnamed elements, limitations and/or features may be added and still form a construct within the scope of the claim. Specific embodiments disclosed herein may be further limited in the claims using the closed-ended transitional phrases "consisting of" or "consisting essentially of" in lieu of or as an amendment for "comprising." When used in the claims, whether as filed or added per amendment, the closed-ended transitional phrase "consisting of" excludes any element, limitation, step, or feature not expressly recited in the claims. The closed-ended transitional phrase "consisting essentially of" limits the scope of a claim to the expressly recited elements, limitations, steps and/or features and any other elements, limitations, steps and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps and/or features specifically recited in the claim, whereas the meaning of the closed-ended transitional phrase "consisting essentially of" is being defined as only including those elements, limitations, steps and/or features specifically recited in the claim and those elements, limitations, steps and/or features that do not materially affect the basic and novel characteristic(s) of the claimed subject matter. Therefore, the open-ended transitional phrase "comprising" (along with equivalent open-ended transitional phrases thereof) includes within its meaning, as a limiting case, claimed subject matter specified by the closed-ended transitional phrases "consisting of" or "consisting essentially of." As such, embodiments described herein or so claimed with the phrase "comprising" are expressly or inherently unambiguously described, enabled and supported herein for the phrases "consisting essentially of" and "consisting of."

Any claims intended to be treated under 35 U.S.C. § 112(f) will begin with the words "means for," but use of the term "for" in any other context is not intended to invoke treatment under 35 U.S.C. § 112(f). Accordingly, Applicant reserves the right to pursue additional claims after filing this application, in either this application or in a continuing application.

All patents, patent publications, and other publications referenced and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard should be construed as an admission that the inventors are not entitled to antedate such disclosure by virtue of prior invention or for any other reason. All statements as to the date or representation as to the contents of these documents is based on the information available to the applicants and does not constitute any admission as to the correctness of the dates or contents of these documents.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A storage sash apparatus comprising: an elongate sash sized and configured for being wrapped around and removably engaged with at least one of a wrist, forearm, arm, neck, leg and ankle of a user, the sash comprising a first panel and an opposing second panel joined to the first panel; the sash defining a single compartment between the first and second panels, proximal a middle of the sash, the compartment sized for removably receiving an at least one personal item there within; the first and second panels defining an opening for allowing access into the compartment; and the sash providing opposing ends flanking the compartment and having a combined length, relative to a width of the compartment, sufficient for wrapping the opposing ends at least once around the user, passing overtop of the compartment, and removably engaging with one another overtop of the compartment, thereby securing the apparatus to the user and also applying an amount of pressure against the compartment so as to assist in preventing the at least one personal item from unintentionally falling out of the compartment, while allowing access to the compartment via the opening.

2. The storage sash apparatus of claim 1, wherein the sash has a length of approximately twenty-eight inches and a height of approximately four inches.

3. The storage sash apparatus of claim 1, wherein the sash is constructed out of a flexible material.

4. The storage sash apparatus of claim 3, wherein the flexible material is at least one of fabric, mesh, plastic, leather and rubber.

5. The storage sash apparatus of claim 1, wherein the at least one opening is positioned along a top edge of the sash.

6. The storage sash apparatus of claim 5, wherein the at least one opening is further positioned proximal a middle of the sash.

7. The storage sash apparatus of claim 1, wherein the at least one opening provides a closure for selectively obstructing the opening and preventing the at least one personal item from unintentionally falling out of the compartment.

8. The storage sash apparatus of claim 7, wherein the closure is a removably engagable flap.

9. The storage sash apparatus of claim 8, wherein the flap is secured to, or otherwise integral with, the second panel and configured for being folded over the opening and engaging the first panel.

10. The storage sash apparatus of claim 7, wherein the closure is an at least one pair of complementary non-permanent engagement mechanisms positioned on each of the first and second panels.

11. The storage sash apparatus of claim 1, wherein the ends of the sash are configured for passing overtop of the at least one compartment when the sash is wrapped around the user.

12. The storage sash apparatus of claim 1, wherein the ends of the sash are configured for being tied together after the sash is wrapped at least once around the user.

13. The storage sash apparatus of claim 1, wherein the ends of the sash provide complementary non-permanent engagement mechanisms.

14. The storage sash apparatus of claim 1, wherein the ends of the sash are configured for being engaged in a position substantially overtop of the at least one compartment.

15. A storage sash apparatus comprising: an elongate sash sized and configured for being wrapped around and removably engaged with a wrist of a user, the sash comprising a first panel and an opposing second panel joined to the first panel; the sash defining a single compartment between the first and second panels, proximal a middle of the sash, the compartment sized for removably receiving an at least one personal item there within; the first and second panels defining an opening for allowing access into the compartment, the opening positioned along a top edge of the sash, proximal the middle of the sash; the second panel providing a flap positioned and configured for selectively folding over the opening and engaging the first panel, thereby obstructing the opening and preventing the at least one personal item from unintentionally falling out of the compartment; and the sash providing opposing ends flanking the compartment and having a combined length, relative to a width of the compartment, sufficient for wrapping the opposing ends at least once around the user's wrist, passing overtop of the compartment, and removably engaging with one another overtop of the compartment, thereby securing the apparatus to the user's wrist and also applying an amount of pressure against the compartment so as to assist in preventing the at least one personal item from unintentionally falling out of the compartment, while allowing access to the compartment via the opening.

16. The storage sash apparatus of claim 15, wherein the ends of the sash are configured for passing overtop of the at least one compartment when the sash is wrapped around the user's wrist.

17. The storage sash apparatus of claim 15, wherein the ends of the sash are configured for being tied together after the sash is wrapped at least once around the user's wrist.

18. The storage sash apparatus of claim 15, wherein the ends of the sash are configured for being engaged in a position substantially overtop of the at least one compartment.

19. A method of wearing the storage sash apparatus of claim 15 comprising the steps of: placing the second panel of the sash in contact with the wrist of the user, such that the-compartment is positioned on an inner surface of the user's wrist; wrapping the sash at least once around the user's wrist so that the opposing ends of the sash pass overtop of the compartment; and tying the opposing ends of the sash together, substantially overtop of and against the compartment, so as to secure the sash in place on the user's wrist and also applying an amount of pressure against the compartment so as to assist in preventing the at least one personal item from unintentionally falling out of the compartment, while allowing access to the compartment via the removably engagable flap.

* * * * *